United States Patent [19]

Muraoka

[11] 4,316,591

[45] Feb. 23, 1982

[54] FIXTURE FOR HOLDING BAG

[76] Inventor: Masao Muraoka, 16210 S. Bonsallo Ave., Gardena, Calif. 90247

[21] Appl. No.: 113,973

[22] Filed: Jan. 21, 1980

[51] Int. Cl.[3] ..... B65B 67/12

[52] U.S. Cl. ..... 248/97; 206/520

[58] Field of Search ..... 248/97, 98, 99, 100, 248/101; 206/519, 520, 516

[56] References Cited

U.S. PATENT DOCUMENTS

| | | | |
|---|---|---|---|
| 2,854,790 | 10/1958 | Hartung | 206/520 |
| 3,441,173 | 4/1969 | Edwards | 206/520 |
| 3,526,316 | 9/1970 | Kalogris | 206/520 |
| 3,737,129 | 6/1973 | Foster | 248/97 |
| 3,826,455 | 7/1974 | O'Donnell | 248/97 |
| 4,248,278 | 2/1981 | Blodgett | 248/99 |

*Primary Examiner*—James A. Leppink

*Attorney, Agent, or Firm*—Smyth, Pavitt, Siegemund & Martella

[57] ABSTRACT

A fixture for holding upright a plastic bag of the type used by grocery stores in packaging moist items, having a substantially rectangular base with two arms extending vertically from either side of the base. The plastic bag is placed so that its mouth folds back over the arms of the fixture. The bag may be used for disposal of wet garbage.

2 Claims, 3 Drawing Figures

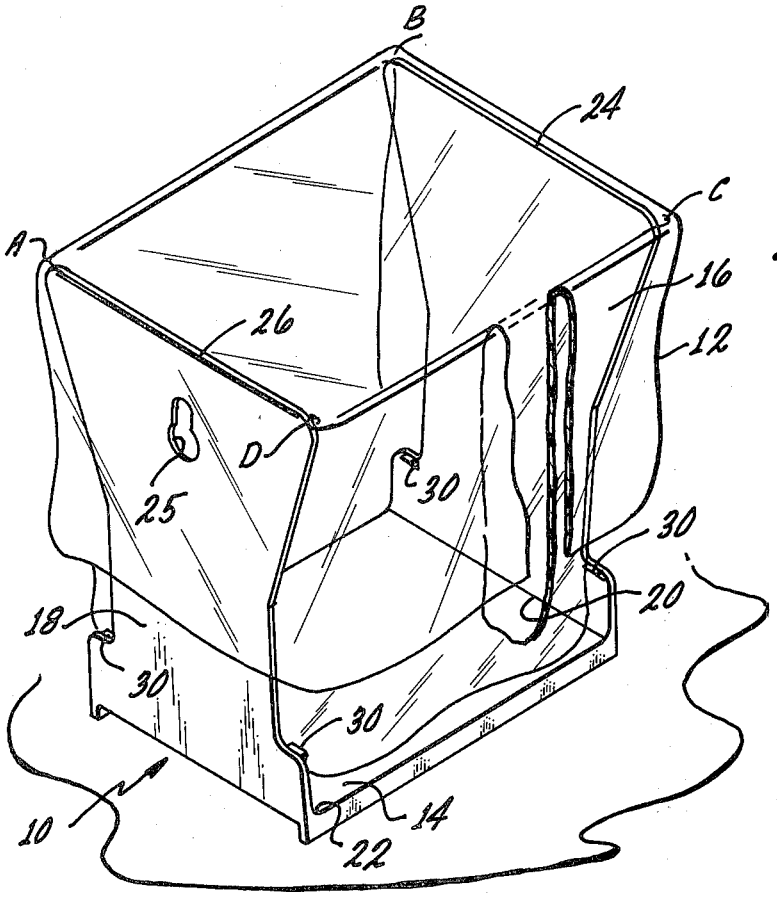
FIG. 1
FIG. 2
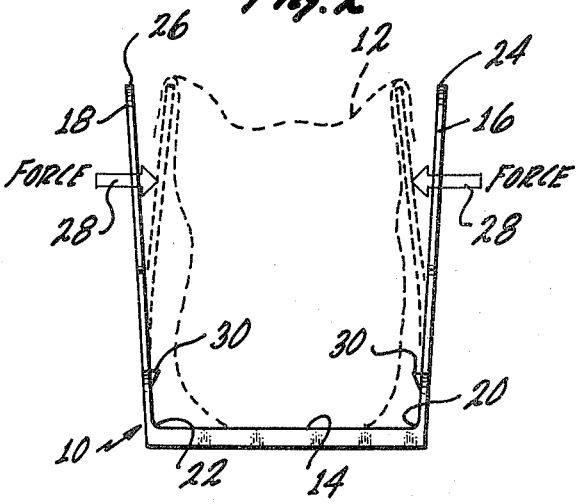
FIG. 3
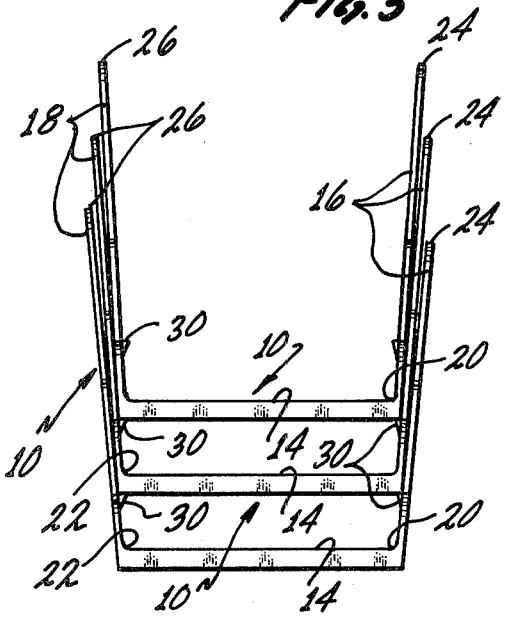

FIXTURE FOR HOLDING BAG

BACKGROUND OF THE INVENTION

The present invention is in the field of fixtures, and in particular relates to a fixture for holding a plastic bag in an upright position with the mouth of the bag open.

Plastic bags are now commonly provided by grocery stores for packaging moist items, to prevent the moisture from getting on the items which should be kept dry. Normally, when the consumer arrives home she disposes of the plastic bag. However, such plastic bags can be of considerable use if they are saved, and the fixture of the present invention facilitates these uses, thereby permitting the bag to be used at least twice.

One use of the present invention is to hold the plastic bag in an upright position and with the mouth of the bag open for use as a receptacle for garbage in the kitchen. In this use, the fixture would sit in the kitchen sink or next to the kitchen sink. Because the mouth of the plastic bag is held open, garbage can be thrown into it without the necessity of opening the bag specifically for that purpose. Further, because the bag is watertight, moisture from the garbage is kept inside the bag.

In a preferred embodiment, the invention is a unitary structure molded of plastic and having a substantially rectangular base from opposite sides of which two arms extend, so that the structure has a generally U-shape. Normally, the base sits on a horizontal surface, and the arms extend vertically from the base.

The user flexes the arms toward each other while pulling the edge of the mouth of the bag down over the upper end of the arms. When the arms are released, they spring back to their original positions, thereby holding the mouth of the bag open. To dispose of the bag it is necessary only to lift it vertically by the mouth, thereby disengaging it from the fixture.

Further aspects of the invention both regarding its structure and operation will be clarified by reference to the attached drawings which illustrate a preferred embodiment of the invention.

BRIEF DESCRIPTION OF THE DRAWINGS

FIG. 1 is a perspective view of a preferred embodiment of the present invention;

FIG. 2 is a side elevation view of the fixture of FIG. 1; and,

FIG. 3 is a side elevation view showing several of the fixtures of FIG. 1 stacked.

DETAILED DESCRIPTION OF THE PREFERRED EMBODIMENT

Turning now to the drawings, in which like parts are denoted by the same reference numeral throughout, there is shown in FIG. 1 a perspective view of a preferred embodiment of the fixture 10 of the present invention. As shown in the drawings, the fixture 10 holds a bag 12 in an upright position and holds the mouth of the bag open.

The fixture 10 includes a base 14 which normally extends horizontally and from which a first arm 16 and a second arm 18 extend vertically in spaced relationship to present generally solid walls or continuous surfaces as shown in FIG. 1.

In a preferred embodiment, the base 14 is substantially rectangular, and the first arm 16 extends from a first end 20 of the base while the second arm 18 extends from an opposite second end 22 of the base. The first arm 16 extends upwardly and terminates in an upper end 24, while the second arm 18 extends upwardly and terminates in an upper end 26.

In a preferred embodiment, the entire fixture 10 is molded of plastic and has a unitary structure. Plastic is used in the best mode of practising the invention because it is inexpensive, light in weight, rust-free, and presents a smooth non-porous surface which can easily be kept clean. In an alternative embodiment, sheet metal is used. In other embodiments, the upper ends 24, 26 may be curved, and the fixture may be provided with lightening holes, or a slot 25 for hanging the fixture on a wall-mounted hook.

As shown in FIG. 2, the fixture is designed to have a particular amount of flexibility. Specifically, the arms 16, 18 should be flexible enough so that they can be moved toward one another by application of a modest force. The arms 16, 18 are moved together to facilitate engagement of the bag 12 with the fixture. Further, the fixture 10 must have sufficient elasticity that when the arms 16, 18 are released, they return to substantially their original position.

In the preferred embodiment of FIG. 1, when the fixture is standing upright and before the plastic bag is engaged, the distance A–B–C–D is greater than the girth of the plastic bag. This insures that the plastic bag will compress the arms 16, 18 toward each other so that the elastic restoring forces set up in the fixture will maintain the engaged bag in an open condition.

In operation, it is extremely simple and easy for the average housewife to engage the bag 12 to the fixture 10; this can be done in a single continuous motion is desired.

In a first method of engaging the bag 12 to the fixture, the bag is held mouth down, the arms 16, 18 are squeezed together, and are inserted into the mouth of the inverted bag. The arms 16, 18 are then released and the bottom of the bag is then drawn downwardly into the space between the arms, thereby turning the bag inside out relative to its original condition.

In a second method of engaging the bag 12 to the fixture 10, the bag 12 is placed in an upright position in the space above the base and between the arms, the arms are then squeezed together and the top edge of the bag is folded outwardly and down over the upper ends of the arms to the position shown in FIG. 1, and then the arms are released.

FIG. 2 shows that when a modest force indicated by the arrow 28 is applied to the arms 16, 18, they flex from their original position shown in the solid lines to their flexed position shown in the dashed lines. When the force is released, the arms return to their original position.

FIG. 3 is a side elevation view showing the manner in which several of the fixtures are stacked. Lugs 30 are provided on the arms 16, 18 to prevent the excessive spreading of the arms that would otherwise occur if the fixtures were forced together either by their own weight or by an external force.

Thus, there has been described a fixture for holding a plastic bag in an upright position with the mouth of the bag held open. The fixture 10 permits the plastic bags 12 to be re-used, thereby conserving materials. In addition to being used as a receptacle for moist garbage in a kitchen, the plastic bag held by the fixture can also be used to catch dripping water from leaky plumbing and can be used as a toilet under emergency conditions.

Although a preferred embodiment and several alternative embodiments have been described above, it is clear that other embodiments would be apparent to those skilled in the art. The present invention is deemed to include the obvious variations, and is limited only by the following claims.

What is claimed is:

1. A unitary stackable fixture for holding open a bag, said fixture comprising:

a base extending horizontally;

a pair of arms unitary with said base and cantilevered from said base in upwardly divergent spaced relationship and terminating in upper ends to define a space above said base and between said arms into which a user places the bag in an upright position;

said base and said pair of arms constituting a structure sufficiently flexible to permit the user to flex the upper ends towards each other from their original positions by application of a modest force to facilitate the user in engaging the bag to the structure by folding the top edge of the bag down over the upper ends of said arms;

the structure being sufficiently elastic that when the user removes the applied modest force the arms spring back to their original positions thereby holding the bag open;

said arms including generally solid walls constructed so as to contain said bag between said arms against substantial outward spread of solid matter deposited in said bag, which spread would interfere with the easy unimpeded removal of said bag from said fixture;

said base not extending beyond said arms to form a stackable U-shaped structure, each of said arms including one or more lugs extending into said space between said arms to prevent excessive spreading of the arms when the fixtures are stacked by limiting the extent to which such stacked fixtures can nest one within the other.

2. The fixture of claim 1 wherein said base and said pair of arms consist of a plastic.

* * * * *